United States Patent [19]

Molayem et al.

[11] 4,388,877

[45] Jun. 21, 1983

[54] METHOD AND COMPOSITION FOR COMBUSTION OF FOSSIL FUELS IN FLUIDIZED BED

[75] Inventors: Benjamin Molayem, Silver Spring; David Garrett, Fort Washington, both of Md.

[73] Assignee: Benmol Corporation, Alexandria, Va.

[21] Appl. No.: 280,978

[22] Filed: Jul. 7, 1981

[51] Int. Cl.[3] ..... F23B 7/00

[52] U.S. Cl. ..... 110/342; 44/1 SR; 110/343; 110/344; 110/345

[58] Field of Search ..... 110/342, 343, 344, 345; 44/15 R

[56] References Cited

U.S. PATENT DOCUMENTS

| | | | |
|---|---|---|---|
| 4,084,545 | 4/1978 | Nack et al. | 110/342 X |
| 4,154,581 | 5/1979 | Nack et al. | 110/342 X |
| 4,173,454 | 11/1979 | Heihs | 110/342 X |
| 4,191,115 | 3/1980 | Yang et al. | 110/218 X |

*Primary Examiner*—Edward G. Favors

*Attorney, Agent, or Firm*—James J. Brown

[57] ABSTRACT

A method and composition are described for carrying out the combustion of fossil fuels in a fluidized bed with reduced emissions of sulfur, carbon and nitrogen oxides and unburned hydrocarbons. Combustion is carried out in the presence of a solid sulfur oxide adsorbent and a metal or metal oxide component which is catalytically active with respect to unburned hydrocarbons, carbon monoxide and nitrogen oxide.

9 Claims, No Drawings

METHOD AND COMPOSITION FOR COMBUSTION OF FOSSIL FUELS IN FLUIDIZED BED

This invention relates to a process for the fluidized bed combustion of fossil fuels wherein combinations of adsorbents and catalysts are utilized as bed materials (called SORCAT by the Inventors).

Fossil fuels which are combusted according to the present invention include coal, lignite, peat, oil shale, tar sand, bitumens, petroleum crude and its fractions, natural gases, fuel gases derived from gasification of other fuels, and synthetic liquids or solids derived from other fuels.

BACKGROUND OF THE INVENTION

It is known to combust coals or other fuels in fluidized beds of adsorbent materials in order for sulfur oxide gases emanating from sulfurous materials in the coals or other fuels to be adsorbed or captured by the bed material and not otherwise released in the flue gases derived from the combustion process. During these combustion processes, wherein sulfur oxides are captured by beds of adsorbent materials, other environmental contaminants such as unburned hydrocarbons, nitrogen oxides and carbon monoxide are, however, generally released in the flue gas in various concentrations.

It is also known that various catalytic materials can be used for combustion processes, such as automobile exhaust gases, for the purpose of reducing emissions of unburned hydrocarbons, oxidizing carbon monoxide to carbon dioxide and reducing nitrogen oxides to nitrogen. These catalytic converters generally pass sulfur oxides through unchanged or oxidize sulfur oxides to their highest level of oxidation thereby producing constituents of airborne sulfites and sulfates which may contribute, along with hydrocarbons and nitrogen oxides, to atmospheric phenomena known as "smog" and "acid-rain".

It has not, however, been proposed to employ combinations of adsorbents and catalysts together in fluidized combustion beds to reduce emissions of all of these contaminants, nor has it been recognized that the use of these respective components in combination realizes enhanced reduction of sulfur oxides and other contaminating emissions.

DESCRIPTION OF THE INVENTION

The present invention relates to a process which captures the sulfur oxides emitted by combustion of sulfur bearing fuels and also oxidizes unburned hydrocarbons to carbon dioxide, oxidizes carbon monoxide to carbon dioxide and reduces nitrogen oxides to nitrogen. The adsorbent and catalytic components can be regenerated when their adsorbent and catalytic properties become diminished in the process of the invention.

The present invention is based on compositions of solid materials produced by combining adsorbent and catalytic substances and their use in fluidized bed combustion processes for fuels. The solid materials comprise an adsorbent matrix for capture and retention of sulfur oxides. Physically combined with the adsorbent matrix or otherwise present in the fluidized bed, are catalytic materials. These catalytic materials are metals or their oxides, alone or in combination.

The adsorbent matrix used according to the invention is

Calcium Carbonate (limestone)

Dolomites

Alkali and alkaline earth metal oxides, aluminates, titanates, vanadates, chromates or salts of other amphoteric metal oxides.

Preferred are: $CaO$, $CaCO_3$, $CaAl_2O_4$, $BaTiO_3$, $CaTiO_3$.

Combined with the adsorbent component are the following catalytic materials preferably by impregnation onto the matrix:

Base metals or their oxides such as: Fe, Ni, CO, Mo, Mn, Cu, Zn, Cr.

Precious metals or their oxides such as: Ir, Pt, Pd, Rh, Re.

Preferred catalytic materials are: Pt, Pd, Rh; each alone or in combinations.

Preferred range of catalyst to adsorbent matrix is from 0.05 to 0.5 weight percent and most preferred 0.05 to 0.2 weight percent. Where combinations of the precious metals are used, the preferred weight ration of Pt/Pd is 5/3 to 5/1, and the preferred weight ratio of Pt/Rh is 5/1 to 12/1.

The combined use of the adsorbent matrix and catalytic component together has been found to result in enhanced reductions of the respective contaminating emissions beyond what is found when adsorbent and catalyst are separately employed.

The present invention is carried out in a fluidized combustion bed in which the bed material is maintained in an expanded, fluid state by air and gaseous combustion products. The expanded fluidized bed, during combustion may have a depth from 1–16 feet and preferably is from 4–12 feet. Spent bed material is continuously withdrawn during operation, and replaced with fresh or regenerated sorbent-catalyst at a rate such that the molar ratio of sulfur sorbent active cation per part of sulfur in the feed fuel is maintained in the range of 0.5 to 10, preferably in the range of 1 to 5, and most preferably 1.5 to 3.

While separation is not necessary, since the ash is inert with regard to regeneration and subsequent recycle to the combustion process, spent bed material can be separated from ash by screening, elutriation or other methods known in the art. The spent bed material can then be regenerated with regard to its sulfur capture capability.

The combination sorbent-catalyst (SORCAT) of the present invention can be regenerated with regard to its $SO_2$ adsorbent capabilities, by the method of Ruth et al. "Environmental Science and Technology", volume 13, No. 6, June, 1979, and by the method of Snyder et al. "Sulfation and Regeneration of Synthetic Additives", Proceedings of the Fourth International Conference on Fluidized Bed Combustion, December, 1975, or by other methods known in the art. Therefore, the sorbent-catalyst need not be discarded but may be recycled many times before being processed to recover the catalytic metals.

The sorbent-catalyst material which comprises the fluidized bed is diluted with fuel ash when solid fuels are combusted in the bed, however, there is very little ash in the bed during oil combustion, and virtually no ash in the bed when gases are combusted. By its nature, the carbon content of the bed, during combustion is very low-of the order of 0–6% and preferably 0–0.6%. The rate of bed material withdrawal is based upon the efficiency of sulfur capture from combustion gases.

The range of velocities for combustion gases in the fluidized bed during fluidized bed combustion may be from 1 to 14 actual cubic feet of gas per second per square foot of fluidized bed area, however, the preferred range of operation is 4 to 10 actual cubic feet of gas per second per square foot of fluidized bed area.

The following examples are provided to demonstrate the present invention and are not limiting with respect to the scope thereof.

EXAMPLE 1

A high sulfur bituminous coal from the Sewickley seam was combusted in a conventional fluidized bed combustor in which Greer limestone was the fluid bed material. The need for limestone bed material was to remove sulfur oxides from the combustion gases, generated within the fluid bed by the coal combustion. Conditions for the operation are shown in Table 1.

This operating data shows that a combustion efficiency of 81.92% was achieved with a calcium-to-sulfur molar ratio of 2.5 when combusting a coal of heating value=12,931 Btu per pound. The effluent flue gas contained environmental contaminants equivalent to:

$SO_2$=2.49 pounds per million Btu $NO_x$=1.06 pounds per million Btu

CO=2.54 pounds per million Btu

Unburned Hydrocarbon=0.20 pounds per million Btu

This identical type of coal was then thermally combusted in a fluidized bed combustion chamber with sorbent-catalyst A, which was produced by impregnating, agglomerated and calcined barium titanate particles prepared, with 0.1 weight % Pt plus 0.02 weight % Pd plus 0.01 weight % Rh. Conditions for this operation are shown in Table 2.

This operating data shows that a combustion efficiency of 86.03% was achieved with the coal of heating value=12,931 Btu per pound. The effluent gas contained environmental contaminants equivalent to:

$SO_2$=0.03 pounds per million Btu $NO_x$=0.04 pounds per million Btu

CO=0.02 pounds per million Btu

Unburned Hydrocarbon=0.05 pounds per million Btu

TABLE 1

| | Stream | | | |
|---|---|---|---|---|
| Analysis | Coal Feed | Limestone Feed | Combustion Air | Flue Gas (Dry) |
| Carbon, wt % | 69.90 | | | |
| Hydrogen, wt % | 4.53 | | | |
| Nitrogen, wt % | 0.96 | | 76.80 | 81.50 |
| Oxygen, wt % | 5.46 | | 23.2 | 3.42 |
| Sulfur, wt % | 4.03 | 0.20 | | |
| Moisture, wt % | 1.57 | 0.19 | | 7.47 |
| Ash, wt % | 13.55 | 14.94 | | |
| Lime (CaO), wt % | | 44.30 | | |
| $CO_2$, wt % | | 40.37 | | 14.79 |
| CO, wt % | | | | 0.28 |
| $SO_x$ ($SO_2$ + $SO_3$), ppm | | | | 1,200. |
| $NO_x$ (NO + $NO_2$), ppm | | | | 429. |
| Hydrocarbons, (as $CH_4$), ppm | | | | 393. |
| HCl, ppm | | | | 42. |
| Temperature within Fluidized Bed = 1560° F. | | | | |
| Gas Velocity $ft^3/sec\text{-}ft^2$ = 7.4 | | | | |

TABLE 2

| | Stream | | | |
|---|---|---|---|---|
| Analysis | Coal Feed | Sorbent-Catalyst A | Combustion Air | Flue Gas (Dry) |
| Carbon, wt % | 69.90 | | | |
| Hydrogen, wt % | 4.53 | | | |
| Nitrogen, wt % | 0.96 | | 76.8 | 82.46 |
| Oxygen, wt % | 5.44 | | 23.2 | 3.04 |
| Sulfur, wt % | 4.03 | | | |
| Moisture, wt % | 1.52 | | | 8.04 |
| Ash, wt % | 13.55 | | | |
| $CO_2$, wt % | | | | 14.49 |
| CO, wt % | | | | .0023 |
| $SO_x$ ($SO_2$ + $SO_3$), ppm | | | | 146. |
| $NO_x$ (NO + $NO_2$), ppm | | | | 18. |
| Hydrocarbons (as $CH_4$), ppm | | | | 27. |
| Temperature within Fluidized Bed = 1587° F. | | | | |
| Gas Velocity, $ft^3/sec\text{-}ft^2$ = 8.3 | | | | |

EXAMPLE 2

The coal as described in Example 1 was thermally combusted in a fluidized bed combustion chamber with sorbent-catalyst B which was produced by co-precipitation from solution mixtures of sodium silicate, sodium hydroxide, sodium aluminate and calcium nitrate. The slurry which resulted was filtered, washed, dried and then heated to 1110° C., thus forming a material with empirical structure $(CaO)_3(S_iO_2.\ Al_2O_3)1/2$. This material was then impregnated with a solution mixture of chloroplatinic acid, palladium chloride and rhodium chloride such that the total metal loading was 0.2 weight percent of the previously prepared dry powder, and the platinum to palladium ratio was 5:2 by weight and the platinum to rhodium ratio was 9:1 by weight. The resulting moist powder was pelleted in a pellet press and the pellets were calcined at 400° C.

Conditions for this operation are shown in TABLE 3.

A portion of the material prepared, with empirical formula $(CaO)_3$ $(S_iO_2.Al_2O_3)1/2$, was pelleted without treatment with the catalytic compounds, Pt, Pd and Rh, and used in the same combustion process. These results are shown in TABLE 4.

TABLE 3

| | Stream | | | |
|---|---|---|---|---|
| Analysis | Coal Feed | Sorbent-Catalyst, B | Combustion Air | Flue Gas (Dry) |
| Carbon, wt % | 69.90 | | | |
| Hydrogen, wt % | 4.53 | | | |
| Nitrogen, wt % | 0.96 | | 76.8 | 81.74 |
| Oxygen, wt | 5.44 | | 23.2 | 3.3 |
| Sulfur, wt % | 4.03 | | | |
| Moisture, wt % | 1.52 | | | (8.60) |
| Ash, wt % | 13.55 | | | |
| $CO_2$, wt % | | | | 14.87 |
| CO, wt % | | | | .06 |
| $SO_x$ ($SO_2$ + $SO_3$), ppm | | | | 214. |
| $NO_x$ (NO + $NO_2$), ppm | | | | 86. |
| Hydrocarbons (as $CH_4$), ppm | | | | 58. |
| Temperature within Fluidized Bed = 1612° F. | | | | |
| Gas Velocity, $ft^3/sec\text{-}ft^2$ = 7.9 | | | | |

TABLE 4

| Analysis | Stream: Coal Feed | Sorbent $(CaO)_3(S_iO_2.Al_2O_3)_{\frac{1}{2}}$ | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 81.81 |
| Oxygen, wt % | 5.46 | 0. | 23.2 | 3.2 |
| Sulfur, wt % | 4.03 | 0. | | |
| Moisture, wt % | 1.57 | | | (7.82) |
| Ash, wt % | 13.55 | | | |
| $CO_2$, wt % | | | | 14.63 |
| CO, wt % | | | | 0.30 |
| $SO_x$ ($SO_2$ + $SO_3$), ppm | | | | 280. |
| $NO_x$ (NO + $NO_2$), ppm | | | | 480. |
| Hydrocarbons (as $CH_4$), ppm | | | | 393. |
| Temperature within Fluidized Bed = 1580° F. | | | | |
| Gas Velocity, $ft^3/sec\text{-}ft^2$ = 8.0 | | | | |

EXAMPLE 3

A quantity of calcium titanate was prepared by dry blending stoichiometric quantities of dry powders of calcium carbonate and titanium dioxide and heating the resultant mixture in a kiln at 1100° C.

A portion of the calcined powder was slurried with a mixture of chloroplatinic acid, palladium chloride and rhodium chloride solutions, evaporated to dryness and calcined over 400° C. The resultant solids were pelleted and used, as in Example 1, for the fluidized bed combustion of the coal used in Example 1. This bed material, referred to as sorcat C had 0.1 weight percent Pt+Pd+Rh admixed therein, with 5/3 being the ratio of Pt/Pd, and 5/1 being the ratio of Pt/Rh.

Results of this combustion appear in TABLE 5.

The remaining portion of prepared calcium aluminate, without catalytic materials treatment, was likewise used to combust the coal of Example 1. These results appear in TABLE 6.

TABLE 5

| Analysis | Stream: Coal Feed | Sorbent-Catalyst C | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 81.37 |
| Oxygen, wt % | 5.46 | | 23.2 | 2.70 |
| Sulfur, wt % | 4.03 | 0. | | |
| Moisture, wt % | 1.57 | 0. | | (8.42) |
| Ash, wt % | 13.55 | | | |
| $CO_2$, wt % | | | | 15.90 |
| CO, wt % | | | | 0.01 |
| $SO_x$ ($SO_2$ + $SO_3$), ppm | | | | 94. |
| $NO_x$ (NO + $NO_2$), ppm | | | | 90. |
| Hydrocarbons (as $CH_4$), ppm | | | | 75. |
| Temperature within Fluidized Bed = 1594° F. | | | | |
| Gas Velocity, $ft^3/sec\text{-}ft^2$ = 7.2 | | | | |

TABLE 6

| Analysis | Stream: Coal Feed | Calcium Titanate | Combustion Air | Flue Gas (Dry) |
|---|---|---|---|---|
| Carbon, wt % | 69.90 | | | |

TABLE 6-continued

| Analysis | Stream: Coal Feed | Calcium Titanate | Combustion Air | Flue Gas (Dry) |
|---|---|---|---|---|
| Hydrogen, wt % | 4.53 | | | |
| Nitrogen, wt % | 0.96 | | 76.8 | 81.77 |
| Oxygen, wt % | 5.44 | | 23.2 | 2.81 |
| Sulfur, wt % | 4.03 | | | |
| Moisture, wt % | 1.52 | | | (8.06) |
| Ash, wt % | 13.55 | | | |
| $CO_2$, wt % | | | | 15.05 |
| CO, wt % | | | | 0.36 |
| $SO_x$ ($SO_2$ + $SO_3$), ppm | | | | 418. |
| NO (NO + $NO_2$), ppm | | | | 326. |
| Hydrocarbons (as $CH_4$), ppm | | | | 494. |
| Temperature within Fluidized Bed = 1578° F. | | | | |
| Gas Velocity, $ft^3/sec\text{-}ft^2$ = 9.1 | | | | |

EXAMPLE 4

A quantity of commercially available calcium aluminate cement, consisting mostly of $CaAl_2O_4$ was subdivided so that half of the quantity in the form of dry powder was admixed with a minimum amount of water to form a stiff paste and extruded through a glass tube. The pellets which were cut from the extrudate were humidified to cure them, then heated to produce maximum strength by forming ceramic bonding. The second half of the original quantity of calcium aluminate cement was admixed with a solution comprising chloroplatinic acid, palladium chloride and rhodium chloride and extruding, pelleting and curing as above, then calcined at over 400° C., labeled sorbent-catalyst D.

This latter portion of calcium aluminate cement, thus was prepared so that it contained 0.1 weight percent metals content comprising Pt, Pd and Rh with a Pt/Pd ratio by weight of 5/1 and at Pt/Rh ratio by weight of 12/1.

Both portions of calcium aluminate cement were then used separately, to combust the coal of Example 1 in a fluidized bed combustion apparatus.

The results for the first calcium aluminate cement material appears in TABLE 7. The results for the second calcium aluminate cement material, containing Pt, Pd and Rh, appears in TABLE 8.

TABLE 7

| Analysis | Stream: Coal Feed | Calcium Aluminate Cement | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.80 | 80.59 |
| Oxygen, wt % | 5.46 | | 23.2 | 2.98 |
| Sulfur, wt % | 4.03 | 0. | | |
| Moisture, wt % | 1.57 | 0. | | (7.70) |
| Ash, wt % | 13.55 | | | |
| $CO_2$, wt % | | | | 16.05 |
| CO, wt % | | | | 0.35 |
| $SO_x$ ($SO_2$ + $SO_3$), ppm | | | | 252. |
| $NO_x$ (NO + $NO_2$), ppm | | | | 644. |
| Hydrocarbons, (as $CH_4$), ppm | | | | 430. |
| Temperature within Fluidized Bed = 1590° F. | | | | |
| Gas Velocity, $ft^3/sec\text{-}ft^2$ = 6.8 | | | | |

TABLE 8

| Analysis | Stream: Coal Feed | Sorbent-Catalyst D | Combustion Air | Flue Gas (Dry) |
|---|---|---|---|---|
| Carbon, wt % | 69.90 | | | |
| Hydrogen, wt % | 4.53 | | | |
| Nitrogen, wt % | 0.96 | | 76.8 | 80.75 |
| Oxygen, wt % | 5.44 | | 23.2 | 2.79 |
| Sulfur, wt % | 4.03 | | | |
| Moisture, wt % | 1.52 | | | (8.42) |
| Ash, wt % | 13.55 | | | |
| $CO_2$, wt % | | | | 16.44 |
| CO, wt % | | | | .02 |
| $SO_x$ ($SO_2$ + $SO_3$), ppm | | | | 116. |
| $NO_x$ (NO + $NO_2$), ppm | | | | 77. |
| Hydrocarbons (as $CH_4$), ppm | | | | 65. |
| Temperature within Fluidized Bed = 1587° F. | | | | |
| Gas Velocity, $ft^3/sec\text{-}ft^2$ = 8.2 | | | | |

I claim:

1. A method for catalytically converting unburned hydrocarbons and carbon monoxide to carbon dioxide and reducing nitrogen oxides to nitrogen in the combustion of fossil fuels in a fluidized bed while absorbing sulfur oxides, which comprises carrying out said combustion in the presence of a catalytic material for catalyzing said conversion and reduction reactions, said catalytic material being physically combined onto an adsorbent matrix selected from the group consisting of calcium aluminate, calcium aluminate cement, barium titanate, and calcium titanate.

2. The method of claim 1 wherein said catalytic material is one or more metals or oxides of metals selected from groups consisting of iron, nickel, cobalt, molybdenum, manganese, copper, zinc, chromium, iridium, platinum, palladium, rhodium, rhenium.

3. The method of claim 2 wherein said catalytic material is one or more metals selected from the group consisting of platinum, palladium and rhodium.

4. The method of claim 1 wherein said catalytic material is impregnated onto said sulfur adsorbent in an amount of 0.05 to 0.5 weight percent based on the weight of catalytic material and adsorbent.

5. The method of claim 1 wherein said fossil fuel is coal.

6. The method of claim 1 wherein the molar ratio of adsorbent material used, is 0.5 to 10 parts per part of sulfur in the fossil fuel being combusted.

7. The method of claim 1 wherein said combined adsorbent and catalytic materials are regenerated to restore their respective adsorbent and catalytic properties.

8. A composition for reducing emissions of sulfur and nitrogen oxides, unburned hydrocarbons and carbon monoxide during the combustion of fossil fuels, said composition comprising 0.05 to 0.5 weight percent of a catalytic material or materials which are one or more metals or oxide of metals selected from the group consisting of iron, nickel, cobalt, molybdenum, magnaese, copper, zinc, chromium, iridium, platinum, palladium, rhodium, rhenium, said catalytic material being physically combined with a sulfur oxide adsorbent selected from the group consisting of calcium aluminate cements barium titanate, calcium titanate and calcium aluminate.

9. The composition of claim 8 wherein said catalytic material is one or more metals selected from the group consisting of platinum, palladium and rhodium and said adsorbent is selected from the group consisting of calcium oxide, calcium carbonate, calcium aluminate, calcium titanate and barium titanate.

* * * * *